US009097108B2

(12) United States Patent
Johnson et al.

(10) Patent No.: US 9,097,108 B2
(45) Date of Patent: Aug. 4, 2015

(54) WELLBORE COMPLETION FOR METHANE HYDRATE PRODUCTION

(71) Applicant: Baker Hughes Incorporated, Houston, TX (US)

(72) Inventors: Michael H. Johnson, Katy, TX (US); Mark K. Adam, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 28 days.

(21) Appl. No.: 14/023,982

(22) Filed: Sep. 11, 2013

(65) Prior Publication Data

US 2015/0068742 A1 Mar. 12, 2015

(51) Int. Cl.

| | |
|---|---|
| ***E21B 43/12*** | (2006.01) |
| ***E21B 43/10*** | (2006.01) |
| ***E21B 43/08*** | (2006.01) |

(52) U.S. Cl.

CPC ..... *E21B 43/108* (2013.01); *E21B 43/08* (2013.01); *E21B 43/122* (2013.01)

(58) Field of Classification Search

CPC ..... E21B 43/12; E21B 43/122; E21B 43/108; E21B 43/08

USPC ..... 166/276, 278

See application file for complete search history.

(56) References Cited

U.S. PATENT DOCUMENTS

| | | | | |
|---|---|---|---|---|
| 6,148,911 | A * | 11/2000 | Gipson et al. | 166/248 |
| 7,413,022 | B2 | 8/2008 | Broome et al. | |
| 7,578,343 | B2 | 8/2009 | Augustine | |
| 7,743,835 | B2 | 6/2010 | Willauer | |
| 7,832,490 | B2 | 11/2010 | Willauer | |
| 7,921,915 | B2 | 4/2011 | Richard et al. | |
| 7,926,565 | B2 | 4/2011 | Duan et al. | |
| 7,954,546 | B2 | 6/2011 | Kim et al. | |
| 8,048,348 | B2 | 11/2011 | Duan et al. | |
| 8,225,863 | B2 | 7/2012 | Hammer et al. | |
| 8,353,346 | B2 | 1/2013 | Johnson et al. | |
| 2003/0075333 | A1 | 4/2003 | Vercaemer et al. | |
| 2004/0177961 | A1 * | 9/2004 | Nguyen | 166/280.2 |
| 2004/0261994 | A1 | 12/2004 | Nguyen et al. | |
| 2007/0144741 | A1 * | 6/2007 | Cho et al. | 166/255.2 |

(Continued)

FOREIGN PATENT DOCUMENTS

| | | | |
|---|---|---|---|
| WO | 2008151311 | A2 | 12/2008 |
| WO | 2010045077 | A2 | 4/2010 |

(Continued)

*Primary Examiner* — Zakiya W Bates

*Assistant Examiner* — Silvana Runyan

(74) *Attorney, Agent, or Firm* — Steve Rosenblatt

(57) ABSTRACT

In a completion for producing methane the bottom hole assembly has a base pipe with porous media surrounding it for equalizing flow along the base pipe. A shape memory polymer foam surrounds the porous media. The borehole can be reamed to reduce produced methane velocities. Surrounding the shape memory polymer is an exterior layer of consolidated proppant or sand that can self-adhere and/or stick to the polymer foam. The proppant or sand can be circulated or squeezed into position although, circulation is preferred. The borehole may enlarge due to shifting sands in an unconsolidated formation as the methane is produced. The bottom hole assembly helps in fluid flow equalization and protects the foam and layers below from high fluid velocities during production.

12 Claims, 2 Drawing Sheets

(56) References Cited

U.S. PATENT DOCUMENTS

| | | | | |
|---|---|---|---|---|
| 2008/0296020 | A1 | 12/2008 | Willauer | |
| 2008/0296023 | A1 | 12/2008 | Willauer | |
| 2009/0032244 | A1 | 2/2009 | Zupanick | |
| 2009/0101353 | A1* | 4/2009 | Crow et al. | 166/373 |
| 2009/0178805 | A1 | 7/2009 | Yemington | |
| 2010/0077594 | A1 | 4/2010 | Richard | |
| 2010/0089565 | A1 | 4/2010 | Duan et al. | |
| 2010/0294513 | A1 | 11/2010 | Van Nieuwkoop | |
| 2011/0067872 | A1 | 3/2011 | Agrawal | |
| 2011/0073296 | A1* | 3/2011 | Richard et al. | 166/56 |
| 2011/0162780 | A1 | 7/2011 | Duan et al. | |
| 2011/0232901 | A1 | 9/2011 | Carrejo et al. | |
| 2011/0252781 | A1 | 10/2011 | Johnson et al. | |
| 2011/0259587 | A1 | 10/2011 | Joseph et al. | |
| 2012/0000648 | A1 | 1/2012 | Mathew et al. | |
| 2012/0145389 | A1* | 6/2012 | Fitzpatrick, Jr. | 166/278 |
| 2012/0181017 | A1 | 7/2012 | Hart et al. | |
| 2012/0247761 | A1 | 10/2012 | O'Malley | |
| 2013/0062067 | A1 | 3/2013 | Guest et al. | |
| 2013/0090854 | A1 | 4/2013 | Rasmus et al. | |
| 2013/0126170 | A1 | 5/2013 | Johnson et al. | |
| 2013/0206406 | A1* | 8/2013 | Kuo et al. | 166/278 |
| 2013/0277068 | A1 | 10/2013 | Richard | |

FOREIGN PATENT DOCUMENTS

| | | | |
|---|---|---|---|
| WO | 2011037950 | A2 | 3/2011 |
| WO | 2011133319 | A2 | 10/2011 |
| WO | 2011162895 | A2 | 12/2011 |

* cited by examiner

WELLBORE COMPLETION FOR METHANE HYDRATE PRODUCTION

FIELD OF THE INVENTION

The field of this invention is completions and more particularly in unconsolidated formations that produce methane hydrate where there is a need for sand control and flow distribution to protect the screen while stabilizing the borehole.

BACKGROUND OF THE INVENTION

Methane hydrate exists as a solid substance in layers that contain sand and other sediment. Hydrate to methane gas and water must be accomplished in order to produce the methane gas. The production of methane hydrate means dissociating methane hydrate in the layers and collecting the resultant methane gas through wells and production systems. To dissociate methane hydrate that is stable at low temperature and under high pressure, there must be an (1) increase the temperature , (2) decrease the pressure, (3) or both. The optimum methane hydrate production method is one based on the "depressurization method." However, since methane hydrate layers are unconsolidated sediments, sand production occurs with the methane gas and water. Because removal of the methane, water, and sand, wellbore stability becomes an issue that cannot be overcome with conventional sand control methodologies. Economical and effective measures for preventing sand production and solving borehole stability issues require a novel approach to completion methodology. The proposed method to control sand production and provide better borehole stability comprises providing a shape memory polymer foam filter that does not depend on the borehole for containment for sand management. The shape memory polymer will be utilized such that a flow path would not be exposed that would permit the production of sand from the borehole. One other issue related to the "depressurization method" of methane hydrate production is the uniform application of a differential pressure across the reservoir interface. The method further comprises a porous media under the shaped memory polymer foam filter that can be varied in number and permeability to balance the differential pressure applied to reservoir being produced. This improves borehole stability via uniform drawdown and flow from the exposed reservoir. While these techniques could be used in a conventional open hole or cased hole completion, it is desirable to under ream or expand the borehole size to help increase reservoir exposure and decrease flow velocities at the sand management/reservoir interface. Additionally, consolidated proppant or sand is deposited adjacent the shape memory foam as it is not the objective to fully occupy the borehole with the foam after it crosses its critical temperature. Instead, in recognition that the hole can be enlarged with initial reaming to reduce fluid velocities or alternatively additional methane production destabilizes the formation and can enlarge the borehole, the consolidated proppant or sand can be an outer protective layer to the foam. Its ability to self-adhere contains the foam and protects the foam from erosive velocity effects of the produced methane.

Several references that employ memory foam in sand control applications are as follows:

WO/2011/162895A;
U.S. Pat. No. 8,353,346
US20110252781
WO/2011/133319A2
US20130062067
WO/2013/036446A1

US20130126170
U.S. Pat. No. 8,048,348
US20100089565
US20110162780
U.S. Pat. No. 7,926,565
WO/2010/045077A2
US20110067872
WO/2011/037950A2
U.S. Pat. No. 7,832,490
US20080296023
US20080296020
U.S. Pat. No. 7,743,835
WO/2008/151311A3

Flow balancing devices are generally discussed in the following references:

U.S. Pat. No. 7,954,546
U.S. Pat. No. 7,578,343
U.S. Pat. No. 8,225,863
U.S. Pat. No. 7,413,022
U.S. Pat. No. 7,921,915

Those skilled in the art will better appreciate additional aspects of the invention from a review of the detailed description of the preferred embodiment and the associated drawings while appreciating that the full scope of the invention is to be determined by the appended claims.

SUMMARY OF THE INVENTION

In a completion for producing methane the bottom hole assembly has a base pipe with porous media within it for equalizing flow along the base pipe. A shape memory polymer foam surrounds the base pipe with porous media. The borehole can be reamed to reduce produced methane velocities. Surrounding the shape memory polymer is an exterior layer of consolidated proppant or sand that can self-adhere and/or stick to the polymer foam. The proppant or sand can be circulated or squeezed into position although, circulation is preferred. The borehole may enlarge due to shifting sands in an unconsolidated formation as the methane is produced. The bottom hole assembly helps in fluid flow equalization and protects the foam and layers below from high fluid velocities during production.

DETAILED DESCRIPTION OF THE PREFERRED EMBODIMENT

Figure 1:
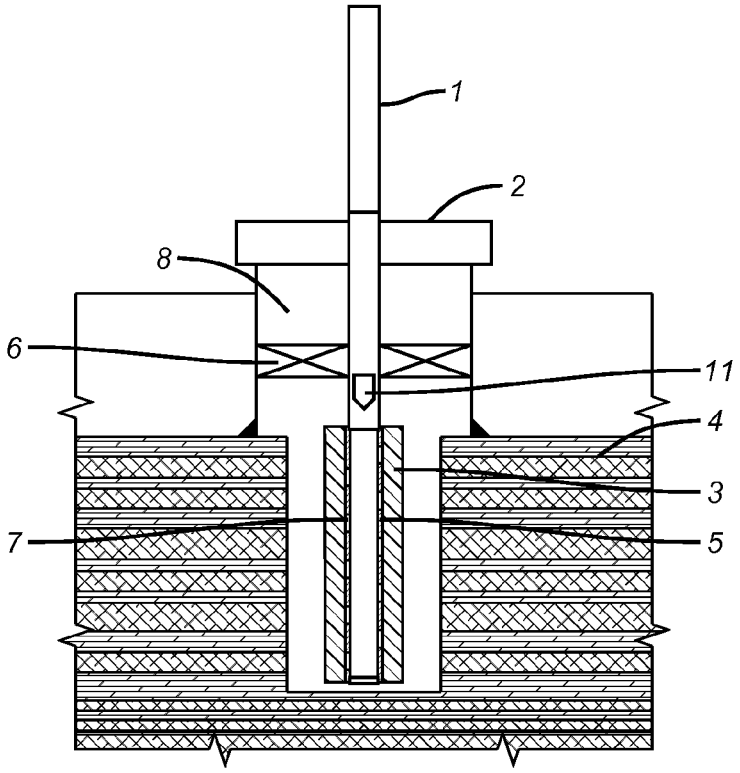
FIG. 1 shows the run in position of the bottom hole assembly with the shape memory polymer foam as yet unexpanded.

Referring to FIG. 1 a work string 1 is run through a wellhead 2. The bottom hole assembly comprises a base pipe 5 which is simply a pipe with openings. A production packer 6 isolates the methane hydrate reservoir 4. A schematically illustrated crossover tool 11 allows placement of the consolidated proppant or sand (gravel) 9 about the shape memory polymer foam 3. The base pipe 5 has flow balancing devices 7 that can be tortuous paths of different resistances to fluid flow or an annularly shaped porous member of different thicknesses or porosities.

Figure 2:
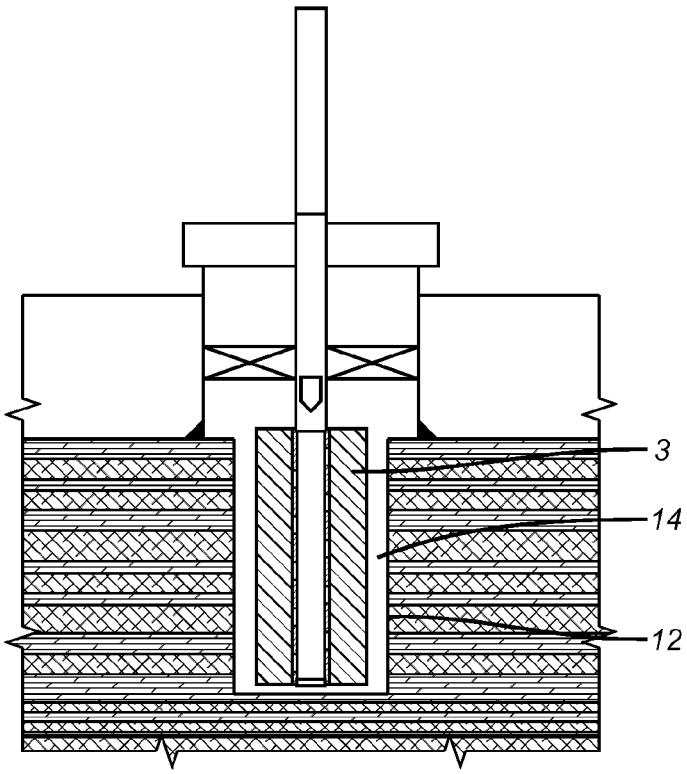
FIG. 2 is the view of FIG. 1 with the polymer foam expanded.
Figure 3:
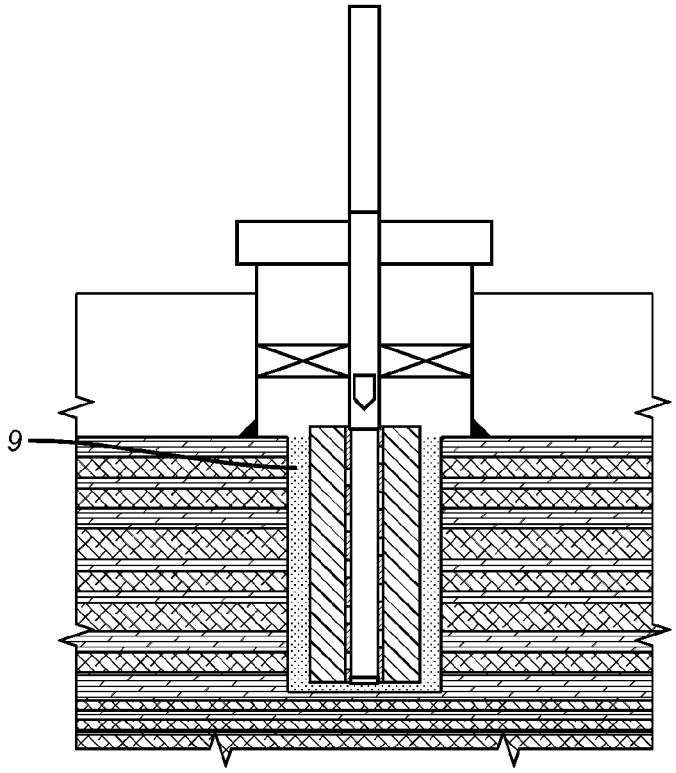
FIG. 3 is the view of FIG. 2 with the consolidated proppant or gravel in position.
Figure 4:
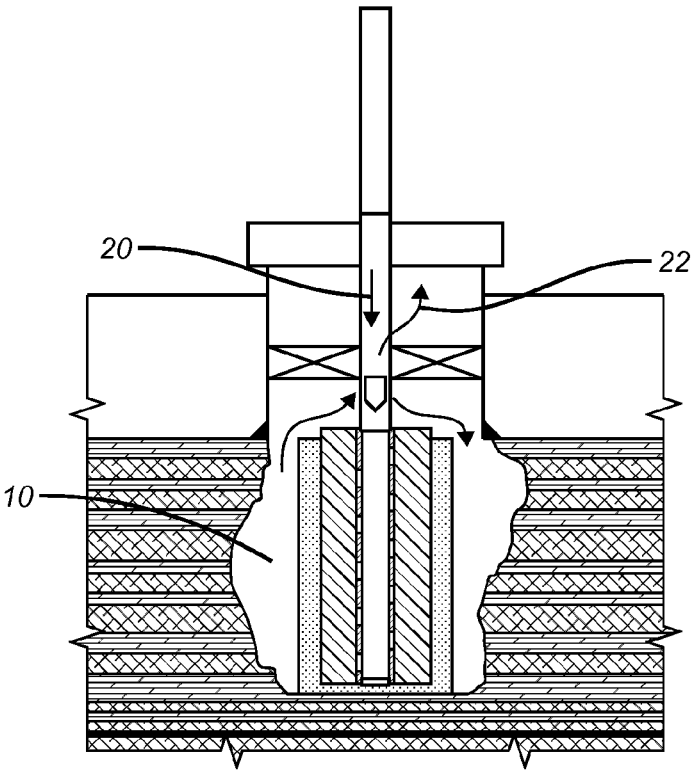
FIG. 4 is the view of FIG. 3 showing the shifting of the unconsolidated borehole wall during methane production.

In FIG. 1 the memory polymer foam is in its run in dimension where it has not yet been warmed above its transition temperature. In FIG. 2 the transition temperature has been reached and the polymer foam 3 has expanded to a location still short of the borehole wall 12 to leave an annular gap 14 into which the proppant or sand 9 will be deposited using the crossover 11 as illustrated in FIG. 3. This is done preferably with circulation with crossover 11 and using a wash pipe that is not shown to direct returns that come through the proppant/sand 9 and the memory foam 3 into the upper annulus 8 above the packer 6. Finally FIG. 4 illustrates the onset of methane production that ensues when the pressure in the formation 4 is allowed to be reduced. With the removal of methane a large void volume 10 can be created. This has the beneficial effect of reduction of fluid velocities for the methane. Those skilled in the art will appreciate that the initial deposition of the proppant or sand 9 could likely fill the remaining annular space around the memory foam 3 by virtue of the addition of the proppant or sand 9 until some pressure resistance is sensed at the surface indicating that the volume in the annulus has packed in. The arrows 20 and 22 schematically illustrate the circulation pattern to deliver the proppant or sand 9 below the packer 6 and taking returns through the upper annulus 8. The delivery of the proppant or sand 9 can begin before, during or after the foam 3 reaches its critical temperature and grows dimensionally. In any of those cases the production of methane can hollow out the reservoir as shown in FIG. 4 so the adherence of the proppant or sand 9 to itself and to the foam helps to keep the components within the foam 3 protected from erosive high gas velocities. The enlarging of the borehole as well as the flow balancing devices 7 also helps to control high velocity gas erosion to keep the bottom hole assembly serviceable for a longer time before a workover is needed.

The combination of flow balancing with the self-adhering proppant or sand 9 covering the memory polymer foam 3 and to some extent adhering to the foam allows for a longer service life as the layers of filtration remain serviceable longer in adverse conditions such as borehole collapse and potential for erosion caused at least in part by flow imbalance induced high gas velocities.

The proppant/sand 9 can be a commercially available product such as Sandtrol®. The foam is available as GeoFORM®. Alternatives can be alloy memory foam or screens of various designs that do not change dimension with thermal stimulus. The screens can be constructed so that they can be radially expanded for borehole support or to reduce the volume needed for the proppant/sand 9. The flow balancing feature can be a porous annular shape or insert plugs in the base pipe or screen materials that vary in mesh size at different opening locations.

The above description is illustrative of the preferred embodiment and many modifications may be made by those skilled in the art without departing from the invention whose scope is to be determined from the literal and equivalent scope of the claims below:

We claim:

1. A completion method for methane production from methane hydrate, comprising:

running in a bottom hole assembly to an isolated producing zone;

providing a plurality of filtration layers in said bottom hole assembly with at least one inner layer on said bottom hole assembly initially delivered to the isolated producing zone and another outer layer that is independently delivered to the producing zone when the bottom hole assembly is in position in said isolated producing zone;

adhering components of said outer layer to each other or to said at least one inner layer in the isolated producing zone so that said inner and outer layers remain adjoining when the borehole enlarges and moves away from said outer layer when methane is produced.

2. The method of claim 1, comprising:

delivering said outer layer with circulation that returns to the surface through an upper annulus above a production packer.

3. The method of claim 1, comprising:

delivering said outer layer through a crossover tool while squeezing a carrier fluid into the adjacent formation.

4. The method of claim 1, comprising:

reaming the borehole before running in said bottom hole assembly.

5. The method of claim 1, comprising:

providing a base pipe with multiple openings to conduct methane through said bottom hole assembly;

providing a flow balancing feature in at least one of said openings.

6. The method of claim 5, comprising:

providing an annular porous member adjacent at least one said opening.

7. The method of claim 5, comprising:

providing a member that provides a tortuous path in at least one said opening for flow balancing.

8. The method of claim 1, comprising:

providing a shape memory material as said at least one inner layer.

9. The method of claim 8, comprising:

bringing said shape memory material to beyond its critical temperature while leaving open a surrounding annular gap for the delivery of said outer layer after enlargement of said shape memory material.

10. The method of claim 8, comprising:

providing a shape memory polymer foam as said at least one inner layer.

11. The method of claim 10, comprising:

retaining said components of said outer layer to each other to hold shape when said borehole enlarges as methane is produced.

12. The method of claim 10, comprising:

retaining components of said outer layer to said shape memory polymer foam.

* * * * *